US005850723A

United States Patent [19]

Kallfass

[11] Patent Number: 5,850,723

[45] Date of Patent: Dec. 22, 1998

[54] METHOD AND APPARATUS FOR PACKING ARTICLES IN SHRINK FILM

[75] Inventor: Karl-Heinz Kallfass, Nürtingen, Germany

[73] Assignee: Kallfass Verpackungsmachinen GmbH & Co., Nurtingen, Germany

[21] Appl. No.: 573,144

[22] Filed: Dec. 15, 1995

[30] Foreign Application Priority Data

Dec. 23, 1994 [DE] Germany ..... 44 46 278.6

[51] Int. Cl.[6] ..... B65B 53/02

[52] U.S. Cl. ..... 53/442; 53/557

[58] Field of Search ..... 53/442, 557, 466, 53/228, 229, 586

[56] References Cited

U.S. PATENT DOCUMENTS

| | | | |
|---|---|---|---|
| 3,591,767 | 7/1971 | Mudie . | |
| 3,785,276 | 1/1974 | Noor | 53/442 X |
| 4,991,376 | 2/1991 | Backman | 53/586 |
| 5,001,884 | 3/1991 | Hanagata | 53/557 X |
| 5,299,410 | 4/1994 | Freeman | 53/442 |

FOREIGN PATENT DOCUMENTS

| | | |
|---|---|---|
| 69 33 567 | 8/1969 | Germany . |
| 2 015 874 | 11/1972 | Germany . |
| 2 323 224 | 11/1974 | Germany . |
| 84 11 758 | 7/1984 | Germany . |
| 39 24 871 | 2/1991 | Germany . |

*Primary Examiner*—Linda Johnson
*Attorney, Agent, or Firm*—Gary M. Nath; Nath & Associates

[57] ABSTRACT

When packing articles, particularly sheet stacks, such as computer lists, for transportation and dispatch purposes in a film, thick stacks should be tightly enveloped with a shrink film envelope, so as to increase their transportation stability, whereas the envelope of thin stacks is to remain unshrunk, so as not to deform the stack. It is proposed that both types of articles be passed in the packing line through the shrinkage tunnel, but in the case of articles not to be shrunk by increasing the passage speed and/or decreasing the circulating air speed, the heat transfer conditions are reduced in such a way that no shrinkage occurs. It is also proposed to so control the welding dies or jaws of a longitudinal welding station as a function of the thickness of the articles that thinner packs are more tightly enveloped than thicker packs.

17 Claims, 3 Drawing Sheets

METHOD AND APPARATUS FOR PACKING ARTICLES IN SHRINK FILM

FIELD OF USE AND PRIOR ART

The invention relates to a method and an apparatus for packing different articles, in which the articles are enveloped with shrinkable film and conveyed onto a packing line, which contains a shrinkage tunnel. Part of the shrink film envelopes of the articles are shrunk, but for another part of the articles the shrink film envelope remains unshrunk.

When packing articles, particularly paper sheet layers, such as e.g. publishers' products or computer printouts, which are subsequently to be dispatched, it frequently occurs that thinner and thicker stacks in a random sequence have to be packed. The thicker stacks must be very closely enveloped, so that they have the necessary stability for transportation. They are consequently packed in shrink film, which is shrunk by subsequent heating, so that the film engages closely with the object. However, if it is also wished to shrink very thin stacks, this would lead to a contraction, bending round or creasing of the sheet layers contained therein.

It is therefore already known to carry out a thickness-based sorting of articles enveloped with shrink film and to allow all the articles below a certain thickness to pass round or under the shrinkage tunnel, so that they are subsequently returned to the product line in the original order. However, this is complicated from the apparatus standpoint and leads to problems.

PROBLEM AND SOLUTION

The problem of the invention is to provide a method and an apparatus making it possible to pack with limited apparatus effort and expenditure and improved reliability both thin and thick layers enveloped with shrink film.

This problem is solved by a method in which both parts of the articles are passed through the shrinkage tunnel and during the passage of the part not to be shrunk, the heat action on the shrink film is briefly reduced to a level not adequate for initiating shrinkage.

Preferably the shrinkage or non-shrinkage of the enveloped articles is determined on the basis of type, format, thickness, characteristics and/or weight. In each case as a function of the material characteristics of the article and film a limit is set up to which shrinkage is still appropriate. Below this limit the only enveloped article is passed without shrinkage through the shrinkage tunnel. Both parts (shrunk and unshrunk) can be supplied to the shrinkage tunnel in a random sequence, i.e. in chaotic manner.

The reduction of the heat action on the shrink film can be brought about by different measures. One of the most effective measures is to increase the passage speed of the articles through the shrink tunnel compared with the speed provided for shrinkage purposes. This increase is normally more than twice and preferably three to five times the shrinkage speed. As a result the residence time in the shrinkage tunnel is shortened. When reference is made here to a "shrinkage tunnel", this means the area in which the film can be shrunk under heat action.

A further measure for avoiding shrinkage, which is preferably performed simultaneously with the speed increase, is the reduction of the heat transfer conditions in the shrinkage tunnel, particularly by reducing hot air rate or turbulence. In the shrinkage tunnel the heat transfer normally takes place by hot air circulation. If e.g. the fans are stopped or their speed is greatly reduced, then the heat transfer through the then virtually stationary air is much lower than in the case of full circulating air operation, so that as a result an unshrunk passage is made possible or facilitated.

Also in the case of unshrunk packed particles the packing must engage relatively tightly so as to ensure no slipping of the articles, particularly sheet layers, within the packing and consequently ensuring communications security. However, in the case of shrunk articles there must be a certain shrink film reserve, to ensure that there is no tearing at the edges of the article of the tightly stretched shrink film. This is also important for a possibly following bar code or character reading. This problem can be solved in that the articles to be packed, prior to the passage through a shrinkage tunnel are provided with an envelope or covering closed on all sides by welding and the relative oversize of said envelope or covering with respect to the external dimensions of the article, is modified as a function of the dimensions, particularly the thickness of the articles to be packed. Thus, a relatively thin sheet layer, which is not subsequently shrunk, can be very closely packed, whereas the subsequently shrunk sheet layer during enveloping with the shrink film receives a corresponding addition. This can be solved by an apparatus in which in the packing line is contained an enveloping station for enveloping the articles with a shrink film and a following longitudinal welding station, the welding dies or jaws of the longitudinal welding station being controllable as a function of signals of a sensor, e.g. for the thickness measurement, for the articles in their spacing from the longitudinal edges of said articles.

A packing device for articles can preferably have control means for reducing the heat action on the shrink film to an amount which causes no shrinkage and which, as desired and briefly are operable during the passage of part of the articles. These control means can contain a speed control for the conveyor, which conveys the articles through the shrinkage tunnel. Simultaneously or in place thereof there can also be a control for a circulating air heating device, particularly through the speed control or the stopping of one or more blower motors. As this construction is electrically switchable, it is particularly simple from the apparatus standpoint, whereas also possible mechanical deflections or disconnections of the air flow are mechanically more complicated due to the necessary, controllable flaps.

In a regulation of the circulating air heating system it is also necessary to provide a heating regulator, so as to avoid overheating. In order to decide on shrunk or unshrunk passing through in automatic manner and as a function of the nature, thickness, characteristics, weight or format of the articles, sensors can be provided, e.g. height sensors in the manner of light barriers, weighing cells, etc. They can be positioned upstream of the shrinkage tunnel. However, they are preferably located upstream of a frontal enveloping station or longitudinal welding station. In this case, as a function of the dimensions, particularly the thickness of the articles, the longitudinal welding station could be so controlled that it envelops the articles with a varying tightness level, in that the spacing of the longitudinal welding jaws from the longitudinal edges of the articles and therefore from one another is controlled.

In order to avoid any switching of the shrinkage tunnel from shrinkage operation to non-shrinkage operation when an article is located in it, so that then there would be an incomplete shrinkage, it must be ensured that the is free from articles prior to switching over. This can be detected by corresponding sensors (light barriers, etc.), e.g. located at the shrinkage tunnel inlet and/or outlet, which control a buffer station positioned upstream of the shrinkage tunnel and which in the case of a switching over, i.e. during the sequence from articles to be shrunk and not shrunk, the corresponding gap in the flow of articles is produced.

These and further features can be gathered from the claims, description and drawings and the individual features, both singly and in the form of subcombinations, can be implemented in an embodiment of the invention and in other fields and can represent advantageous, independently protectable constructions for which protection is hereby claimed.

BRIEF DESCRIPTION OF THE DRAWINGS

An embodiment of the invention is described in greater detail hereinafter relative to the drawings, wherein show.

DESCRIPTION OF THE EMBODIMENT

Figure 1:
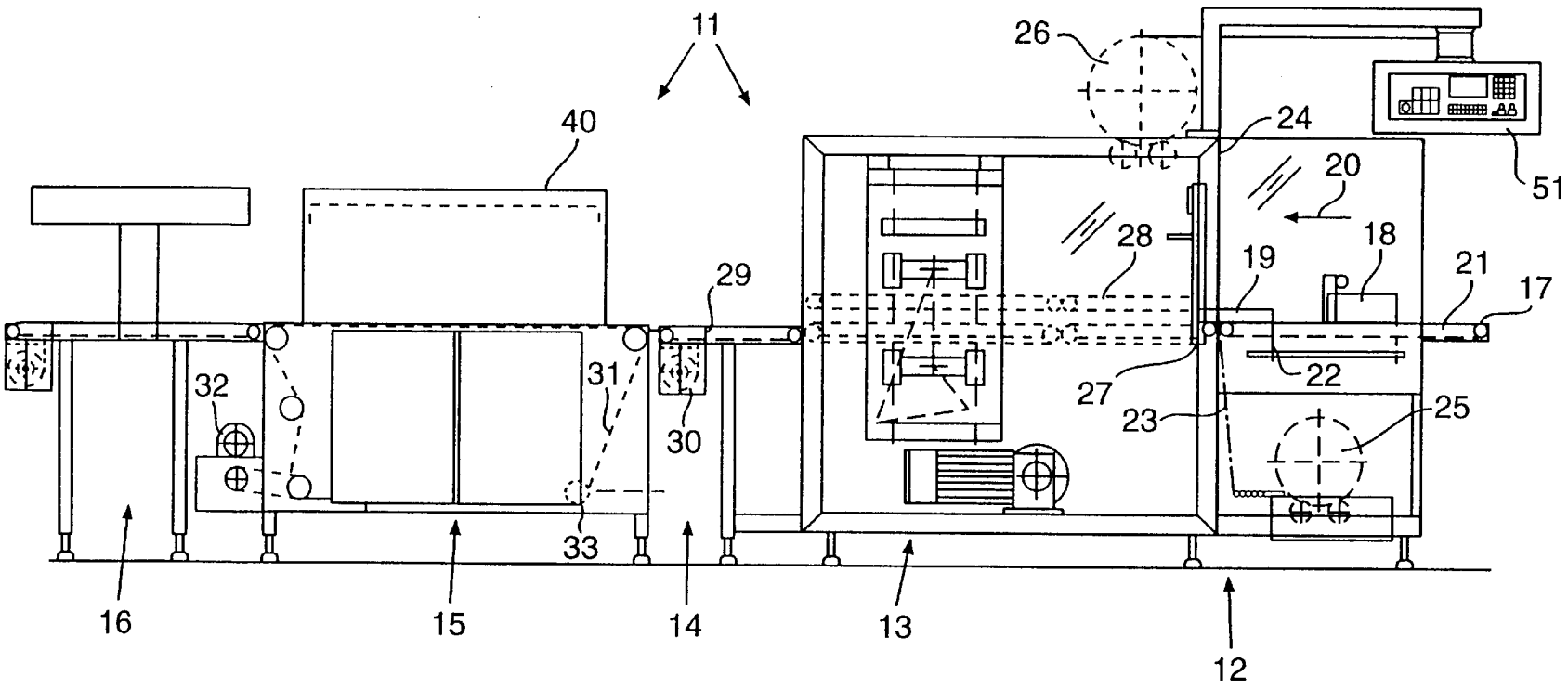
FIG. 1 A diagrammatic side view of a packing line with a shrinkage tunnel.
Figure 2:
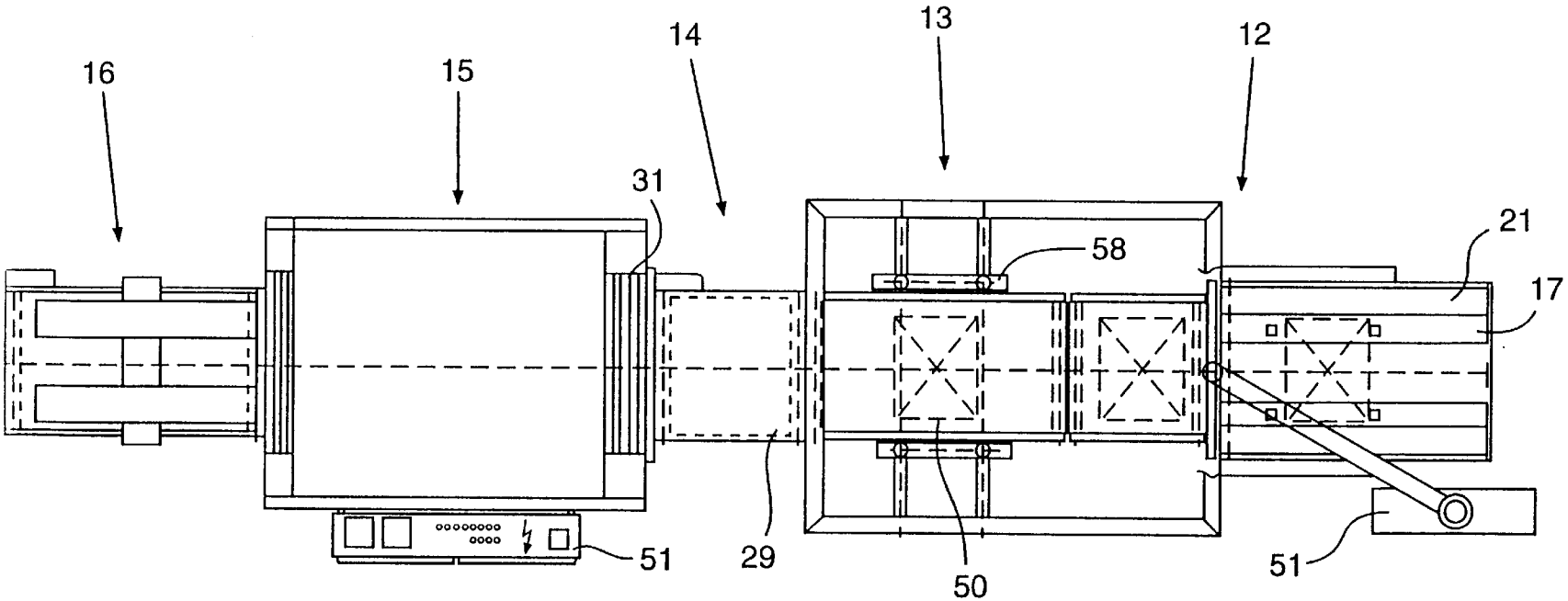
FIG. 2 A plan view of the packing line.

In order, a packing line 11 contains a banderoling station 12, a longitudinal welding station 13, a buffer station 14, a shrinkage tunnel 15 and a discharge and cooling station 16. A multiply subdivided belt conveyor 17, which conveys the articles 18, 19 successively in the conveying direction 20 through the stations passes through all of the latter.

At the inlet of the packing line is provided a support table 21, on which are manually or automatically placed the articles, e.g. printed products or printouts from an individual printer, e.g. computer lists. The support table has a transporting system with grippers 22, which grip through the free or exposed conveyor belt and shove the articles in precise orientation into the banderoling station 12.

In the banderoling station 12 from two shrink film webs 23, 24, unwound from supply rolls 25, 26 above and below the conveying plane 17, a film curtain is formed, into which in the embodiment the article 19 is fed by the gripper 22. The film optionally conveyed in synchronously with the movement is consequently placed tightly round the leading edge and over the top and bottom of the article and over and beyond the trailing edge. At the latter point it is separated by a transverse welding station 27, comprising an upper and lower welding dies, and simultaneously the two separated films are welded together again. Therefore the article is consequently surrounded by a closed banderole, which at the leading and trailing edge has in each case a welding seam and is provisionally open at both sides, where the film projects over the lateral edges. The control of the transverse welding station can take place as a function of the thickness of the article, so that the welding seam is in the centre of the height of the leading or trailing edge.

Two types of articles are shown, namely a relatively high article 18, e.g. a stack of more than 100 sheets of normal paper (10 mm or more) and a very thin article 19, e.g. a paper stack containing less than 100 sheets. Both are dealt with differently hereinafter.

In the longitudinal welding station 13, in which the articles are placed on the belt conveyor 17 accompanied by additional guidance of an upper belt 28, longitudinal welding jaws 58 are provided, which are adjustable and controllable both as regards height and their reciprocal spacing. This can take place by means of not shown hydraulic, pneumatic or electromotive drives, as can the closing movement of the longitudinal welding jaws.

The following buffer station 14 contains a belt conveyor 29 driven independently of the other belt conveyor 17 by an individually controllable drive 30 and which can convey an article 18 or 19 (cf. FIG. 3) located thereon into the shrinkage tunnel 15, in that it transfers the article to the shrinkage tunnel conveyor 31. The latter is also drivable by an independent, largely speed-regulatable or controllable drive 32 and comprises a heat-insensitive conveyor belt, which runs on the underside of the shrinkage tunnel area 33 and then, via tensioning and driving pulleys, returns to the underside of the shrinkage tunnel unit.

Figure 3:
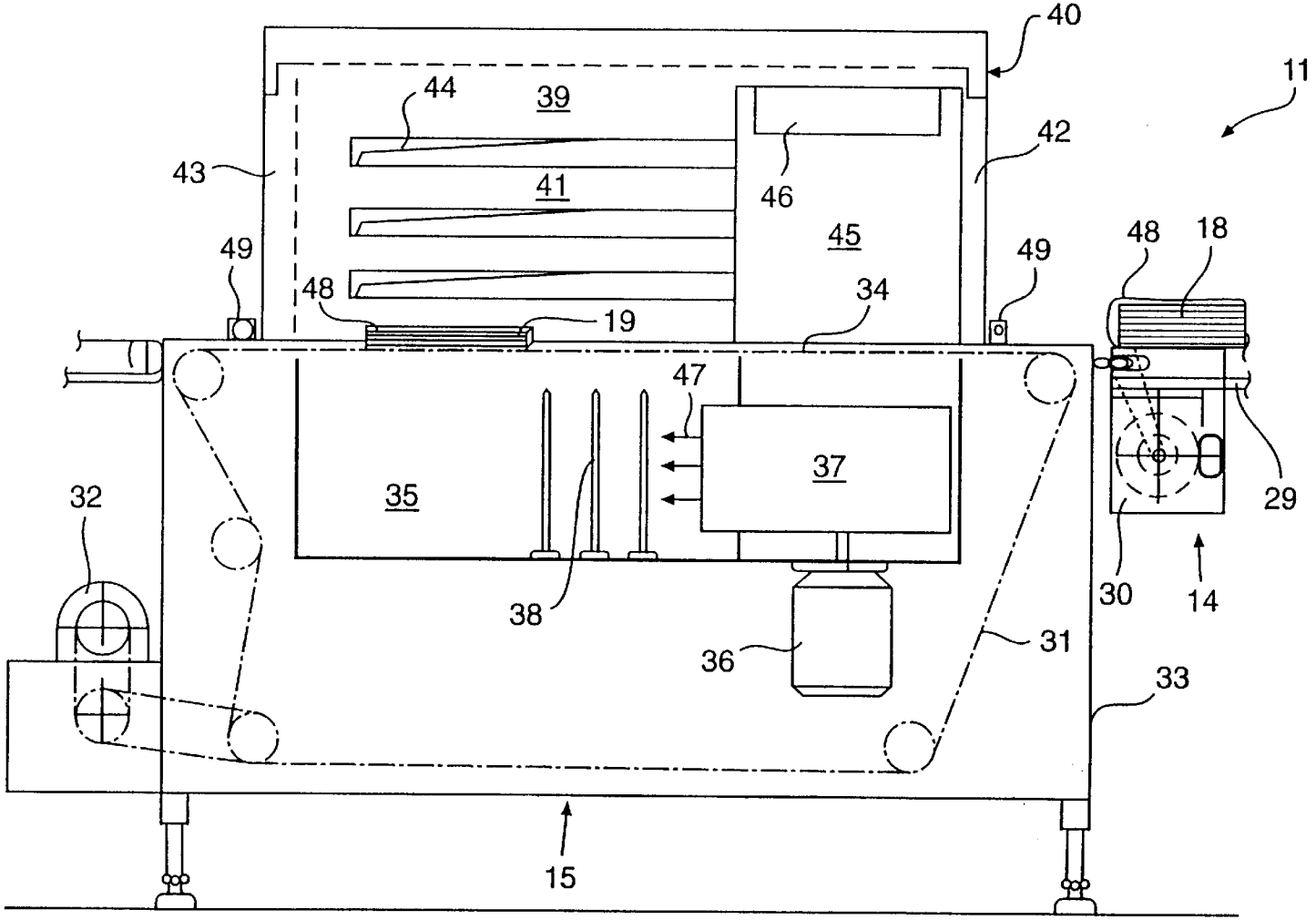
FIG. 3 A diagrammatic, part sectional side view of the packing line detail containing the shrinkage tunnel.

The shrinkage tunnel 15 shown in greater detail in FIG. 3 contains a basic housing 33, in which is guided and mounted the conveyor 31. The strand 34 of the belt conveyor serving as the conveyor and which forms the conveying plane for the articles 18, 19, runs on the upper edge of said housing and above a heating tank 35, in which are located a blower 37 driven by an electric motor 36 and a heating system 38 comprising electric heating rods. The heating system is regulated by a temperature regulating means, so as to avoid overheating in the case of a slight temperature decrease.

From the heating tank extend upwards lateral air circulation ducts 39, which form the side walls of a shrinkage hood 40, which surrounds the tunnel area 41. Through the inlet and outlet openings 42, 43, which are equipped with corresponding curtains or locks, the articles pass into and out of the tunnel area.

The lateral air ducts have outlet slots 44 with not shown control slide valves or flaps, so as to be able to pass the circulating hot air as uniformly as possible onto the articles. Close to the inlet opening 42 is provided a lateral return feed duct 45, which passes by means of a return feed opening 46 the air from the tunnel back into the blower 37, from which it passes out again into the tank 35, as symbolized by the arrow 47. Thus, a circulating heating air system is created, which as a result of its high turbulence and air speed in operation permits a rapid heat transfer to the shrink film envelope 48 of the articles.

In the vicinity of the inlet and outlet openings 42, 43 can be provided sensors, e.g. light barriers 49, for the detection of the articles.

The discharge and cooling station connecting onto the shrinkage tunnel 15 also contains a belt conveyor and ensures a rapid cooling of the shrink film and from there the articles are passed on or palletized.

FUNCTION

Even on the support table 21 or at a random location, the entering articles can be evaluated with respect to their nature and dimensions, the measuring station e.g. being chosen as a function of the clock rate. It is e.g. possible to provide there a light barrier measuring device 49, which differentiates from one another the articles as to whether they are above or below a given thickness, or also measures the thickness in specific stages or continuously. This is of interest for the different working stages. At the time of banderoling in the banderoling station 12 the welding die or jaw movement can be controlled as a function of the thickness of the articles, so that, as has already been stated, the height of the welding seam can be roughly set to the centre of the trailing edge.

However, it is even more important in the following longitudinal welding station. Firstly the height of the upper belts 28 can be set in accordance with the article thickness and secondly not only the height in which the longitudinal welding takes place is adjusted by a corresponding raising of the lower welding die in accordance with the article thickness, but also the distance of the welding dies from the longitudinal edges 50 of the articles. In addition, account is taken of format information (measured or set). Thus, e.g. in the case of a very thin article said spacing or distance is chosen as small as possible, particularly if said article in a manner to be described hereinafter is to be passed in unshrunk manner through the shrinkage tunnel. Then, the longitudinal welding leads to a relatively closely engaging packing closed on all sides and which as a result of the relatively low weight of the complete article can be transported well without any slipping of individual parts of the article, e.g. the individual sheets of a paper stack. This is particularly important, because in the case of packed documents, such as e.g. computer lists, it must be ensured that it is not possible to see between the individual stack sheets without opening the envelope.

However, as a function of the result of the thickness evaluation and controlled by a control and operating unit 51, in the case of a thicker article 18 the spacing of the longitudinal welding dies from the lateral edges 50 of the article is increased, so as to create a shrinkage reserve and avoid during shrinkage the tearing, particularly at corners and edges, of an excessively tightly enveloped shrink film.

Thus, such an all-round, enveloped article is conveyed to the buffer station 14, from where it is passed on into the shrinkage tunnel. If it is a thick article 18, which is i.e. above a thickness limit set on the operating unit, then the shrinkage tunnel is operated normally, i.e. the speed of the shrinkage tunnel conveyor 31 is such that the residence time of the article in the tunnel, together with the air flow produced by the blower 37 and heated by the heating system 38 is sufficient to heat the envelope 48 to above the shrinkage limit of the film, so that the film is tightly shrunk around the article. For this purpose the air is strongly circulated with a temperature of approximately 180° C. and the conveyor 31 is operated at a speed between approximately 2.5 and 5 m per minute. These values are dependent on the shrinkage tunnel length and dimensions, the air movement magnitude, the nature of the articles, the shrink film, etc. After leaving the shrinkage tunnel the article passes through the discharge station and is further processed after cooling.

If an article 19 with a thickness below the limit value arrives in the buffer zone 29, then the control 51 firstly checks whether there is already an article 18 with an envelope 48 to be shrunk in the shrinkage tunnel. This can be determined by means of the sensors 49 either directly through the thickness values measured by them or by an electronic control, which so-to-speak passes on the values measured at the measuring station 49. If this is not the case, then the shrinkage tunnel is prepared for an inactive passage in that the conveyor 31 is brought to a much higher speed, e.g. 15 to 30 m per minute. Simultaneously, the blower 37, by disconnection or regulating down the motor 36, e.g. by a frequency control thereof, can be switched off, so that air only moves slightly within the shrinkage tunnel. Therefore the heat transfer values from the air to the film decrease so much that the article 19, more particularly due to the short residence time due to the higher speed, can traverse the shrinkage tunnel without the film envelope 48 being exposed to shrinkage. This avoids that the shrinkage which is subject to considerable forces, rolls together or creases the relatively thin and flexible article. Through non-shrunk articles also being passed through the shrinkage tunnel, the advantage is obtained that at the end of the packing line the articles are obtained in the same order in which they were introduced, which can be important for a subsequent processing, e.g. dispatch, although they follow one another in "chaotic" manner with respect to their shrinkage or non-shrinkage.

The shrinkage limit can also be chosen as a function of other circumstances, such as e.g. the stability or resistance of a paper of a stack, the weight or other points.

When several similar, i.e. either to be shrunk or not shrunk articles 18, 19 follow one another, it is possible to pass over the buffer station, without any action thereof being necessary. If a number of articles not to be shrunk is followed by an article 18 to be shrunk, then it is stopped at the buffer station until the final article 19 to be shrunk has left the shrinkage tunnel. The speed of the conveyor belt is then reduced to the "shrinkage speed" again and the blower is upwardly regulated. As a function of circumstances it may also be sufficient to only reduce the residence time and to allow the blower to continue to run, if articles not to be shrunk are passed through. The buffer station 14 is also used to accelerate the articles in such a way that they can be brought in trouble-free manner to the different speeds. The regulating up and down of the shrinkage tunnel only takes a short time, so that the maximum tunnel capacity is not reduced. The method and apparatus for passing through the articles with or without shrinkage are also suitable for articles which are only banderoled, i.e. not closed by an envelope on all sides.

I claim:

1. A method for packing a series of different articles in shrinkage film when the film is shrunk about some of the articles and not others, the method comprising the steps of:

enveloping the articles with shrinkage film;

conveying the series of articles on a packing line containing a shrinkage tunnel, the series of articles containing a first group of articles, the shrink film envelope of which is to be shrunk, and a second group of articles, the shrink film envelope of which remains unshrunk;

passing the series of articles through the shrinkage tunnel; and controlling the heat action of the shrinkage tunnel such that during the passage through the shrinkage tunnel of articles belonging to the second group the heat action applied to the whole shrink film envelope is reduced to an amount not sufficient for initiating shrinkage of the film while the heat action applied to articles belonging to the first group causes shrinkage of the film.

2. Method according to claim 1, wherein the shrinkage and non-shrinkage of the envelope is initiated as a function of one of the group of features including nature, format, thickness, characteristics and weight of the articles.

3. Method according to claim 1, wherein enveloped articles of both groups are supplied in a random order to the shrinkage tunnel.

4. Method according to claim 1, wherein for reducing the heat action the speed of the passage of the articles through the shrinkage tunnel is considerably increased compared with the speed used for shrinkage.

5. Method according to claim 1, wherein for reducing the heat action the heat transfer conditions to the whole envelope in the shrinkage tunnel are reduced.

6. Method according to claim 5, wherein the heat transfer conditions are reduced by reducing the hot air speed.

7. Method according to claim 1, wherein the envelopes of articles to be packed, prior to passage through a shrinkage tunnel, are closed on all sides by welding in which the relative oversize of the envelopes compared with the external dimensions of the articles, is modified as a function of the thickness of the articles to be packed.

8. An apparatus for packing a series of articles in shrink film, the series of articles including a first group of articles, the shrink film envelope of which is to be shrunk, and a second group of articles, the shrink film envelope of which is to remain unshrunk, said apparatus comprising:

a packing line including a shrinkage tunnel and conveyor means for moving the series of articles along said packing line; and control means coupled to said shrinkage tunnel for controlling the heat action of said shrinkage tunnel such that during the passage through the shrinkage tunnel of articles belonging to the second group the heat action applied to the whole shrink film envelope is reduced to an amount not sufficient for initiating shrinkage of the film while the heat action applied to articles belonging to the first group is sufficient to initiate shrinkage of the film.

9. Packing apparatus according to claim 8, wherein the control means contain a speed control for a conveyor, which conveys the articles through the shrinkage tunnel.

10. Packing apparatus according to claim 8, wherein the control means incorporate a control for a circulating air heating device of the shrinkage tunnel.

11. Packing apparatus according to claim 10, wherein the control means incorporate speed control means for a blower motor linked with a heating system regulation for the circulating air.

12. Packing apparatus according to claim 8, wherein the control means contains sensors for at least one of a group of characteristics of the articles containing their nature, format, thickness, and weight, the control means initiating, as a function of the signals of the sensors, shrinkage or non-shrinkage of the shrink film envelope of the articles.

13. Packing apparatus according to claim 8, wherein a packing line upstream of the shrinkage tunnel is provided with a buffer station, which in the case of a change of packing type of successively incoming articles holds back differently packed articles until the preceding article has substantially left the shrinkage area in the shrinkage tunnel.

14. Packing apparatus according to claim 8, further comprising a packing line containing an enveloping station for enveloping articles with shrink film and a following longitudinal welding station, welding dies of the longitudinal welding station being controllable as a function of the signals of a sensor for the at least one of a group of characteristics containing nature and dimensions of the articles, with respect to their spacing from the longitudinal edges of said articles.

15. A method for packing a series of articles in shrink film, the series of articles including a first group of articles, the shrink film envelope of which is to be shrunk, and a second group of articles, the shrink film envelope of which is to remain unshrunk, the method comprising the steps of:

enveloping the articles in shrinkage film;

conveying the series of articles enveloped in shrinkage film on a packing line including a shrinkage tunnel;

passing the series of articles through the shrinkage tunnel; and controlling the heat action of the shrinkage tunnel such that during the passage of members of the second group of articles through the shrinkage tunnel, the heat action on the whole shrink film envelope of said articles, is reduced to an amount not sufficient for initiating shrinkage by considerably increasing the speed of travel for members of said second group of articles through the shrinkage tunnel compared with the speed of members of said first group of articles through the shrinkage tunnel for shrinkage.

16. A method for packing a series of articles in shrink film, the series of articles including a first group of articles, the shrink film envelope of which is to be shrunk, and a second group of articles, the shrink film envelope of which is to remain unshrunk, the method comprising the steps of:

enveloping the articles in shrinkage film;

conveying the series of articles enveloped in shrinkage film on a packing line including a shrinkage tunnel;

passing the series of articles through the shrinkage tunnel; and controlling the heat action of the shrinkage tunnel such that during the passage of members of the second group of articles through the shrinkage tunnel, the heat action on the whole shrink film envelope of said articles is reduced to an amount not sufficient for initiating shrinkage by reducing the heat action by reducing the heat transfer conditions in the shrinkage tunnel compared with the heat transfer conditions in the shrinkage tunnel during the passage of the members of said first group of articles for shrinkage.

17. A method for packing a series of articles in shrink film, the series of articles including a first group of articles, the shrink film envelope of which is to be shrunk, and a second group of articles, the shrink film envelope of which is to remain unshrunk, the method comprising the steps of:

enveloping the articles in shrinkage film;

conveying the series of articles enveloped in shrinkage film on a packing line including a shrinkage tunnel;

passing the series of articles through the shrinkage tunnel; and controlling the heat action of the shrinkage tunnel such that during the passage through the shrinkage tunnel of members of the second group of articles, the heat action on the whole shrink film envelope of said articles is reduced to an amount not sufficient for initiating shrinkage by considerably increasing the speed of travel of members of said second group of articles through the shrinkage tunnel compared with the speed of members of said first group of articles through the shrinkage tunnel for shrinkage and the heat transfer conditions in the shrinkage tunnel are also reduced.

* * * * *